US005868650A

United States Patent [19]

Wu

[11] Patent Number: 5,868,650

[45] Date of Patent: Feb. 9, 1999

[54] STATIONARY EXERCISE DEVICE

[76] Inventor: Hsin-Shu Wu, No.1689,Chien Cheng Road, Taichung, Taiwan

[21] Appl. No.: 2,796

[22] Filed: Jan. 5, 1998

[51] Int. Cl.[6] ..... A63B 69/16; A63B 22/04

[52] U.S. Cl. ..... 482/62; 482/51; 482/52

[58] Field of Search ..... 482/51, 52, 53, 482/57, 62, 79, 80, 71, 70

[56] References Cited

U.S. PATENT DOCUMENTS

| | | | |
|---|---|---|---|
| 4,871,164 | 10/1989 | Tseng | 482/62 |
| 5,242,343 | 9/1993 | Miller . | |
| 5,383,829 | 1/1995 | Miller . | |
| 5,562,574 | 10/1996 | Miller . | |
| 5,611,756 | 3/1997 | Miller | 482/57 |
| 5,683,333 | 11/1997 | Rodgers | 482/51 |
| 5,735,773 | 4/1998 | Vittone et al. | 482/52 |

*Primary Examiner*—Stephen R. Crow
*Attorney, Agent, or Firm*—Charles E. Baxley, Esq.

[57] ABSTRACT

A stationary exercise device includes a pair of poles having an upper end rotatably secured to a base at a pivot rod and a pair of brackets slidably engaged on the poles for allowing the brackets to be moved up and down along the poles and to be rotated about the pivot rod. A pair of foot supports are secured to the brackets and moved in concert with the brackets. A crank is rotatably secured to the base and coupled to the foot supports for rotating the foot supports about the pivot rod and for moving the foot supports up and down along the poles such that the foot supports may be caused to move along an elliptical path. A pair of handles are secured to the brackets for supporting the upper portion of the user.

8 Claims, 6 Drawing Sheets

STATIONARY EXERCISE DEVICE

BACKGROUND OF THE INVENTION

1. Field of the Invention

The present invention relates to an exercise device, and more particularly to a stationary exercise device.

2. Description of the Prior Art

U.S. Pat. Nos. 5,242,343, and 5,383,829, and 5,562,574 to Miller disclose three typical stationary exercise devices and comprise a pair of foot supports that may be actuated to move along an elliptical path. However, the foot supports of the exercise devices comprise a front portion slidably engaged with a track and a rear portion coupled to a crank or slidably engaged with another track, such that the exercise devices occupy a large bottom area and include a large volume. In addition, the handles may not be operated.

The present invention has arisen to mitigate and/or obviate the afore-described disadvantages of the conventional stationary exercise devices.

SUMMARY OF THE INVENTION

The primary objective of the present invention is to provide a stationary exercise device which includes a compact size and which includes a configuration that may be adjusted to different sizes.

The other objective of the present invention is to provide a stationary exercise device which includes a pair of handles that may be operated by the user.

In accordance with one aspect of the invention, there is provided a stationary exercise device comprising a base including an upper portion and a lower portion and a middle portion, a pair of poles each including an upper end rotatably secured to the upper portion of the base at a pivot rod, a pair of brackets slidably engaged on the poles respectively for allowing the brackets to be moved up and down along the poles and for allowing the brackets to be rotated about the pivot rod, a pair of foot supports secured to the brackets and moved in concert with the brackets respectively, and means for rotating the foot supports about the pivot rod and for moving the foot supports up and down along the poles. The foot supports are allowed to be moved along an elliptical path when the foot supports are rotated about the pivot rod and moved up and down along the poles.

The brackets each includes at least one pair of rollers for engaging with the poles and for allowing the brackets and the foot supports to be smoothly moved up and down along the poles respectively.

A pair of handles are secured to the brackets and extended upward from the brackets for allowing the handles to be rotated about the pivot rod and to be moved up and down along the poles.

A pair of bellows type sleeves are engaged on the poles for shielding and protecting the poles.

The foot supports rotating and moving means includes a crank rotatably secured to the middle portion of the base and pivotally coupled to the foot supports for allowing the crank to rotate the foot supports about the pivot rod and to move the foot supports up and down along the poles. A device is provided for applying a resistance force against a rotational movement of the crank.

The resistance force applying means includes a first wheel secured to the crank and rotated in concert with the crank for allowing the first wheel to apply the resistance force against the rotational movement of the crank. A second wheel is rotatably secured to the base, and means for coupling the second wheel to the crank and for allowing the second wheel to apply the resistance force against the rotational movement of the crank.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
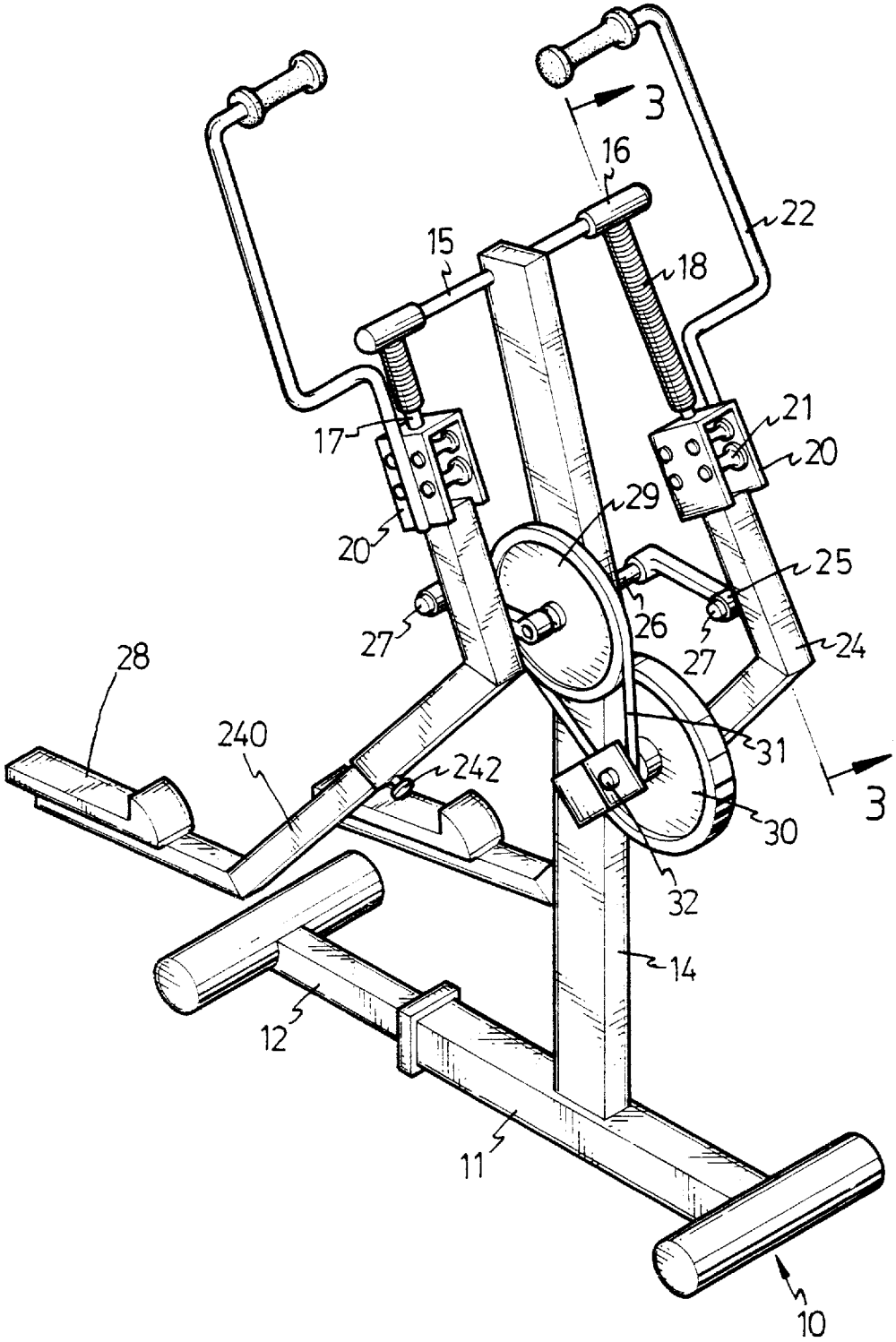
FIG. 1 is a front perspective view of a stationary exercise device in accordance with the present invention.
Figure 2:
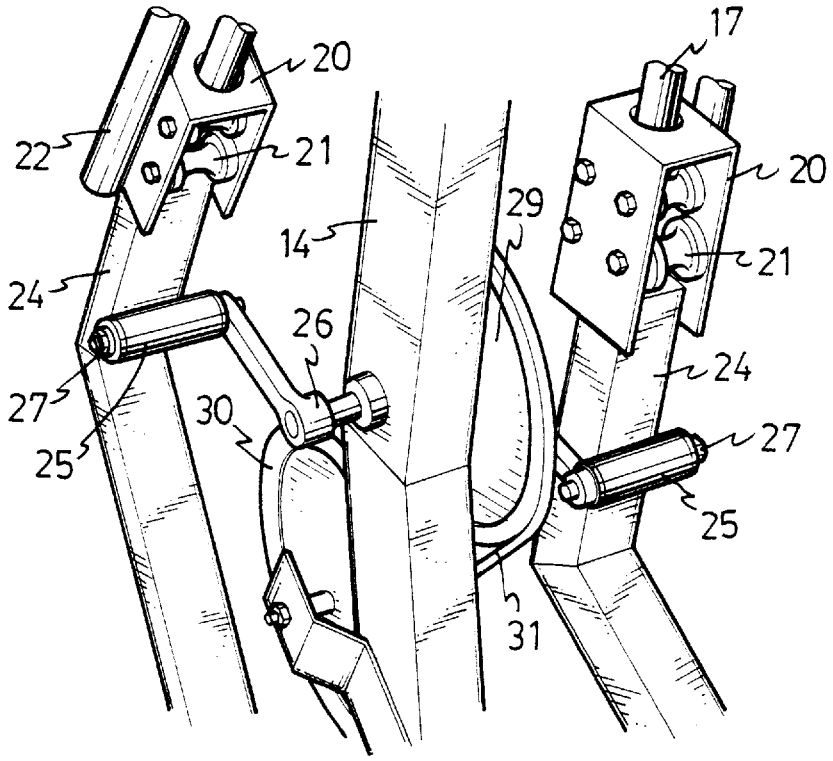
FIG. 2 is a partial rear perspective view of the stationary exercise device.
Figure 3:
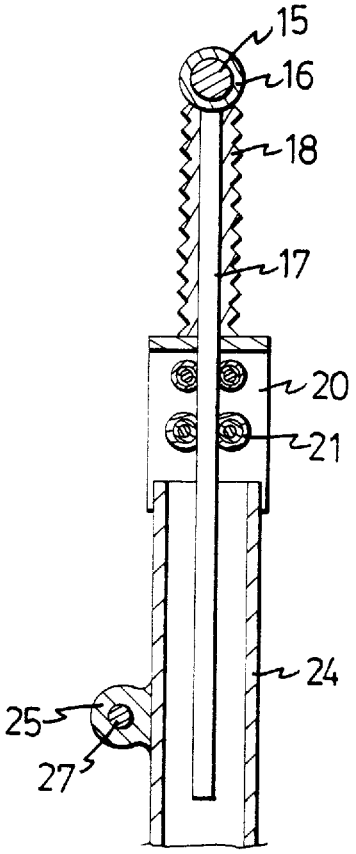
FIG. 3 is a partial cross sectional view taken along lines 3—3 of FIG. 1.
Figure 4:
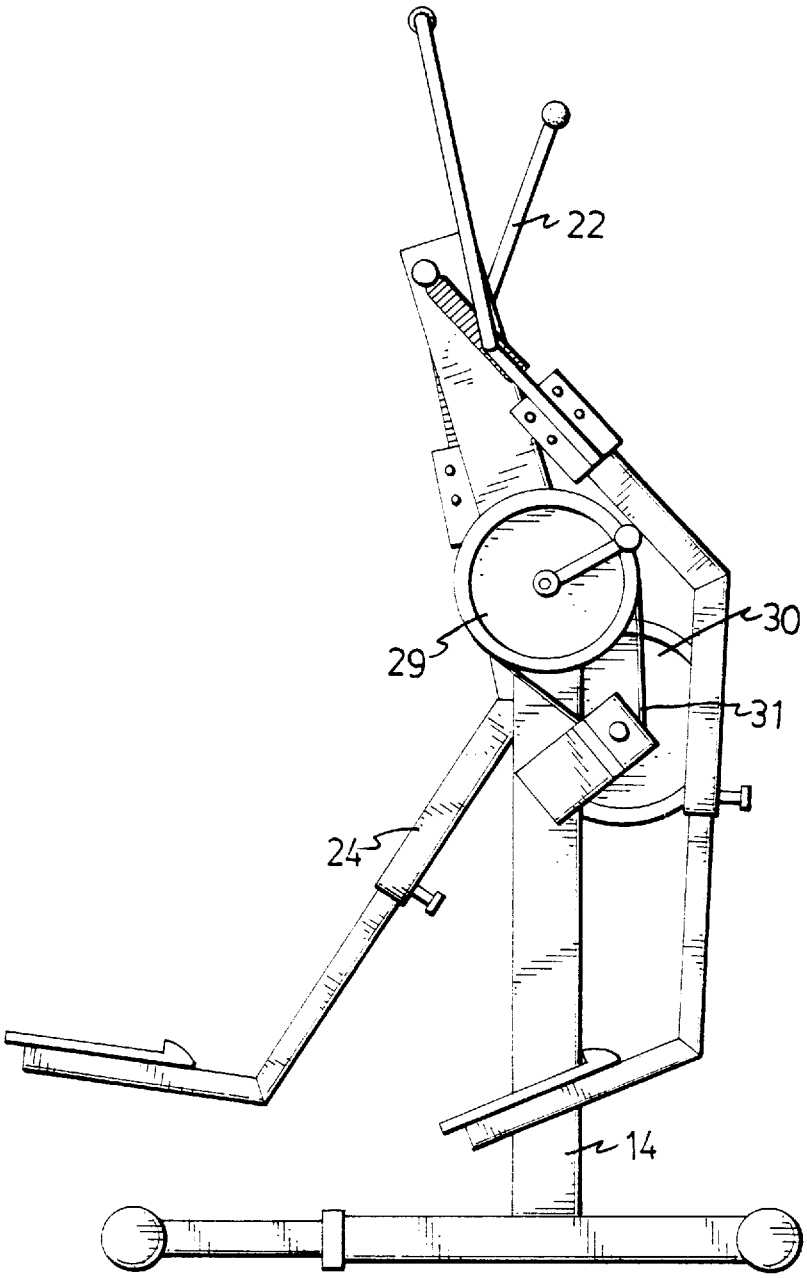
FIGS. 4 and 5 are side views illustrating the operation of the exercise device.

Referring to the drawings, and initially to FIGS. 1–4, a stationary exercise device in accordance with the present invention comprises a base 10 including a tube 11 and an extension 12 slidably engaged in the tube 11 for allowing the extension 12 to be engaged into the tube 11 and to be extended outward of the tube 11 and for allowing the base 10 to be adjusted to different size. The base 10 includes a post 14 extended upward and preferably slightly bent at the middle portion. A pivot rod 15 is secured on top of the post 14. A pair of barrels 16 are rotatably engaged on the end portions of the rod 15. A pair of poles 17 are secured to the barrels 16 and dependent downward from the barrels 16 and rotated in concert with the barrels 16 respectively. A pair of bellows type sleeves 18 are engaged on the poles 17 for shielding and protecting the poles 17.

Figure 5:
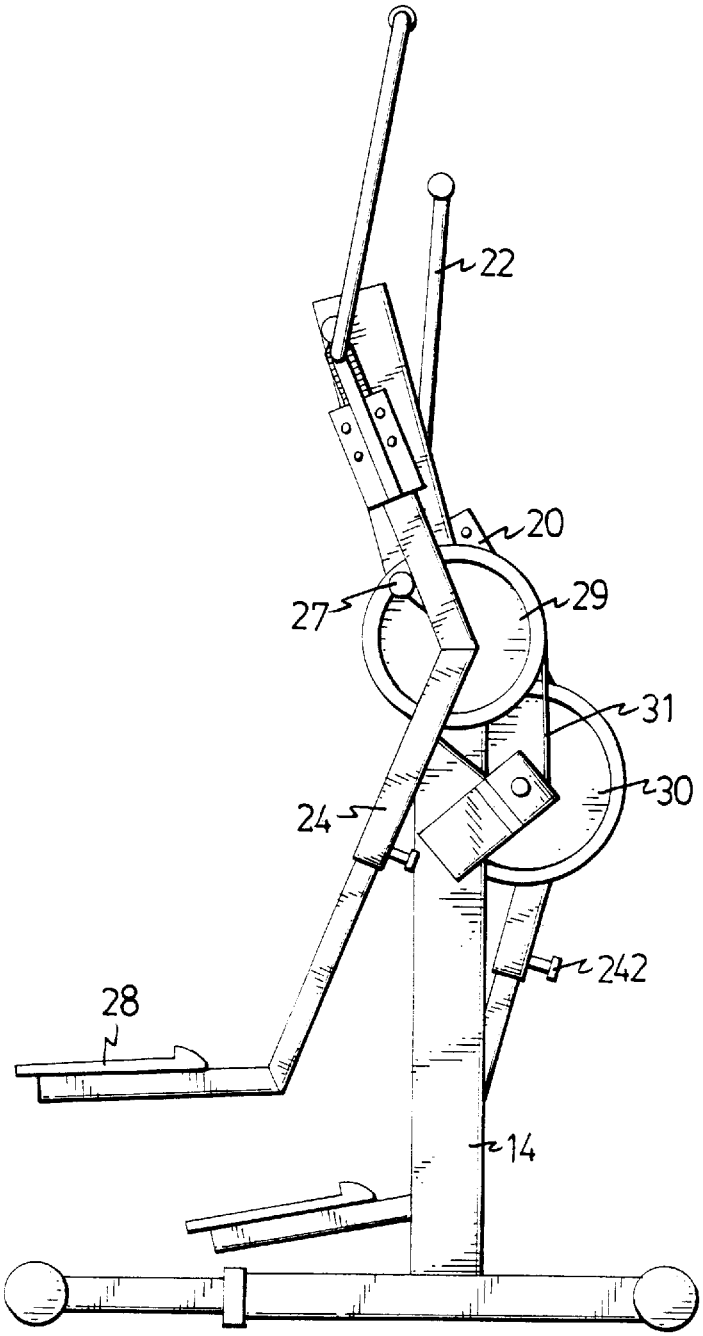
Figure 6:
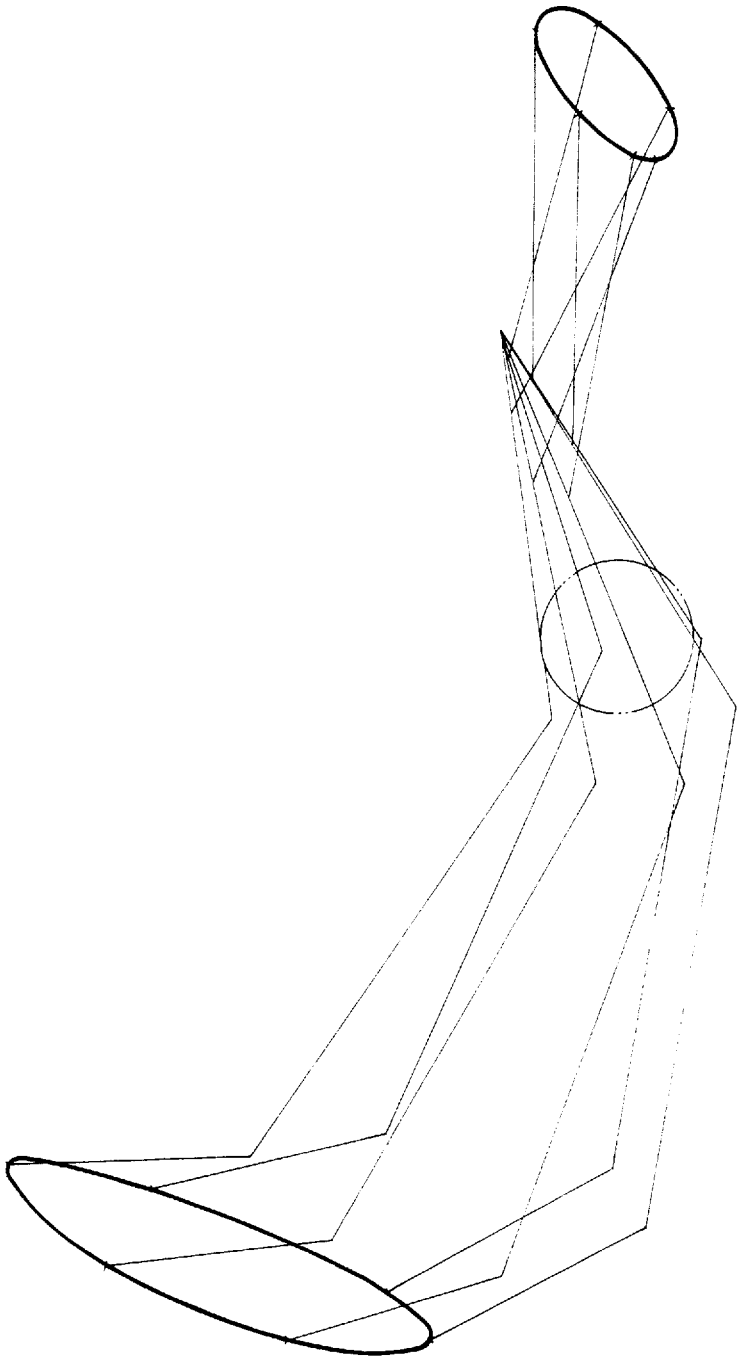
FIG. 6 is a schematic view illustrating the moving paths of the foot supports and of the handles.

A pair of brackets 20 are slidably engaged on the poles 17 and each includes one or more pairs of wheels or rollers 21 engaged with the poles 17 for allowing the brackets 20 to be stably and smoothly slided along the poles 17 respectively. A pair of handles 22 are secured to the brackets 20 and extended upward for supporting the upper portion of the user. Two beams 24 each has an upper end secured to the brackets 20 and moved in concert with the brackets 20 and each has a foot support 28 secured to the bottom portion for supporting the user. The beams 24 each includes a cylindrical member 25 secured to the upper portion. A crank 26 is rotatably secured to the middle portion of the post 14 and is coupled to the cylindrical members 25 of the beams 24 at two shafts 27. The beams 24 and thus the foot supports 28 and the handles 22 may be rotated about the rod 15 by the rotational movement of the crank 26 and may be caused to move up and down along the poles 17 (FIGS. 4 and 5) such that the foot supports 28 and the handles 22 may each be caused to move along an elliptical path (FIG. 6).

It is preferable that a wheel 29 is secured to the crank 26 and rotated in concert with the crank 26. Another wheel or weight 30 is rotatably secured to the post 14 at an axle 32 and is coupled to the wheel 29 or the crank 26 by a coupling member, such as a chain or a belt 31. Alternatively, the wheels 29, 30 may each include a number of teeth formed on the outer peripheral portion and engaged with each other for allowing the wheels 29, 30 to be engaged and coupled together. The wheels 29, 30 may apply a momentum and/or a resistance force against the crank 26 and thus the foot supports 28.

It is preferable that the beams 24 each includes a projection 240 (FIG. 1) that may be adjusted to be extended outward or inward of the beams 24 for adjusting the distance between the foot supports 28 and the handles 22, according to the size of the user. Alternatively, the handles 22 may also be solidly and stably secured to the rod 15 instead of securing to the brackets 20.

Accordingly, the stationary exercise device in accordance with the present invention includes a compact size and includes a configuration that may be adjusted to different sizes. The stationary exercise device includes a pair of handles that may be operated by the user for allowing the user to exercise his upper muscle groups.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stationary exercise device comprising:

a base including an upper portion and a lower portion and a middle portion, a pair of poles each including an upper end rotatably secured to said upper portion of said base at a pivot rod, a pair of brackets slidably engaged on said poles respectively for allowing said brackets to be moved up and down along said poles and for allowing said brackets to be rotated about said pivot rod, a pair of foot supports secured to said brackets and moved in concert with said brackets respectively, and means for rotating said foot supports about said pivot rod and for moving said foot supports up and down along said poles, said foot supports being allowed to be moved along an elliptical path when said foot supports are rotated about said pivot rod and moved up and down along said poles.

2. The stationary exercise device according to claim 1, wherein said brackets each includes at least one pair of rollers for engaging with said poles and for allowing said brackets and said foot supports to be smoothly moved up and down along said poles respectively.

3. The stationary exercise device according to claim 1 further comprising a pair of handles secured to said brackets and extended upward from said brackets for allowing said handles to be rotated about said pivot rod and to be moved up and down along said poles.

4. The stationary exercise device according to claim 1 further comprising a pair of bellows type sleeves engaged on said poles for shielding said poles.

5. The stationary exercise device according to claim 1, wherein said foot supports rotating and moving means includes a crank rotatably secured to said middle portion of said base and pivotally coupled to said foot supports for allowing said crank to rotate said foot supports about said pivot rod and to move said foot supports up and down along said poles.

6. The stationary exercise device according to claim 5, wherein said foot supports rotating and moving means further includes means for applying a resistance force against a rotational movement of said crank.

7. The stationary exercise device according to claim 6, wherein said resistance force applying means includes a first wheel secured to said crank and rotated in concert with said crank for allowing said first wheel to apply the resistance force against the rotational movement of said crank.

8. The stationary exercise device according to claim 7 further comprising a second wheel rotatably secured to said base, and means for coupling said second wheel to said crank and for allowing said second wheel to apply the resistance force against the rotational movement of said crank.

* * * * *